US007974563B2

(12) United States Patent
Sakai et al.

(10) Patent No.: US 7,974,563 B2
(45) Date of Patent: Jul. 5, 2011

(54) IMAGE HEATING APPARATUS AND PRESSURE ROLLER THEREIN HAVING METAL CORE AND TWO ELASTIC LAYERS WITH DIFFERENT THERMAL CONDUCTIVITIES

(75) Inventors: Hiroaki Sakai, Mishima (JP); Norio Hashimoto, Odawara (JP); Yuko Sekihara, Tokyo (JP); Kazuo Kishino, Yokohama (JP); Masaaki Takahashi, Yokohama (JP); Katsuhisa Matsunaka, Inagi (JP); Atsushi Iwasaki, Susono (JP); Hiroyuki Sakakibara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 373 days.

(21) Appl. No.: 12/259,755

(22) Filed: Oct. 28, 2008

(65) Prior Publication Data

US 2009/0116886 A1 May 7, 2009

(30) Foreign Application Priority Data

Nov. 1, 2007 (JP) ..... 2007-284915

(51) Int. Cl.
*G03G 15/20* (2006.01)

(52) U.S. Cl. ..... 399/333

(58) Field of Classification Search ..... 399/333
See application file for complete search history.

(56) References Cited

U.S. PATENT DOCUMENTS

| | | | | |
|---|---|---|---|---|
| 5,246,973 | A | 9/1993 | Nakamura et al. | |
| 6,002,910 | A | 12/1999 | Eddy et al. | |
| 6,567,641 | B1 * | 5/2003 | Stack et al. | 399/330 |
| 7,193,181 | B2 | 3/2007 | Makihira et al. | |
| 7,215,916 | B2 | 5/2007 | Kishino et al. | |
| 7,242,895 | B2 | 7/2007 | Inada et al. | |
| 7,283,145 | B2 | 10/2007 | Kato et al. | |
| 7,305,208 | B2 | 12/2007 | Inoue et al. | |
| 7,321,746 | B2 | 1/2008 | Sakakibara et al. | |
| 7,366,455 | B2 | 4/2008 | Iwasaki et al. | |
| 2007/0065191 | A1 | 3/2007 | Iwasaki et al. | |
| 2007/0223979 | A1 | 9/2007 | Jinzai et al. | |
| 2008/0273904 | A1 | 11/2008 | Nishida et al. | |
| 2009/0003902 | A1 | 1/2009 | Sakakibara et al. | |

FOREIGN PATENT DOCUMENTS

| | | |
|---|---|---|
| JP | 59-37580 | 3/1984 |
| JP | 5-20980 | 8/1993 |
| JP | 8-12888 | 1/1996 |
| JP | 11-116806 | 4/1999 |
| JP | 11-158677 | 6/1999 |
| JP | 2000-39789 | 2/2000 |

(Continued)

*Primary Examiner* — Quana M Grainger
(74) *Attorney, Agent, or Firm* — Fitzpatrick, Cella, Harper & Scinto

(57) ABSTRACT

A pressure member contacts a heating member to form a nip part where a recording material is heated and pinched-conveyed, and includes a first elastic layer and a second elastic layer 24*b* having a higher thermal conductivity than that of the first elastic layer. An elastic layer is formed of a combination of the first elastic layer and the second elastic layer so that the thickness of the second elastic layer at the end portion is thicker than the thickness of the second elastic layer at the center portion in a longitudinal direction perpendicular to a recording material conveyance direction. Accordingly, when using the pressure member to contact the heating member to form the nip part, it is possible to reduce the difference between a center nip width and an end-portion nip width of the nip part.

5 Claims, 9 Drawing Sheets

FOREIGN PATENT DOCUMENTS

| | | |
|---|---|---|
| JP | 2002-351243 | 12/2002 |
| JP | 2003-208052 | 7/2003 |
| JP | 2002-268423 | 9/2003 |
| JP | 2005-273771 | 10/2005 |

* cited by examiner

IMAGE HEATING APPARATUS AND PRESSURE ROLLER THEREIN HAVING METAL CORE AND TWO ELASTIC LAYERS WITH DIFFERENT THERMAL CONDUCTIVITIES

BACKGROUND OF THE INVENTION

1. Field of the Invention

The present invention relates to an image heating apparatus suitable for a heat-fixing apparatus mounted to an image forming apparatus such as an electrophotographic copier and an electrophotographic printer, and a pressure roller used in the image heating apparatus.

2. Description of the Related Art

Among heat-fixing apparatuses mounted to electrophotographic printers or electrophotographic copiers, a thermo roller-type heat-fixing apparatus is known which includes a halogen heater, a fixing roller heated by the halogen heater, and a pressure roller forming a nip part by being brought into contact with the fixing roller. Additionally, a film heating-type heat-fixing apparatus is known which includes a heater having a heating resistor formed on a ceramic substrate, a fixing film sliding on the heater, and a pressure roller forming a nip part together with the heater with the fixing film interposed therebetween. Both the thermo roller-type heat-fixing apparatus and the film heating-type heat-fixing apparatus are configured to heat-fix a toner image onto a recording material by pinching and conveying the recording material bearing unfixed toner image thereon via the nip part.

In the printer mounted with the thermo roller-type heat-fixing apparatus, when small-size recording materials are continuously printed at the same print interval as in a case of printing large-size recording materials, an excessive temperature rise occurs in a non-paper passing area of the fixing roller, the non-paper passing area indicating an area where the recording material does not pass. Additionally, in the printer mounted with the film heating-type heat-fixing apparatus, when small-size recording materials are continuously printed at the same print interval as in a case of printing large-size recording materials, an excessive temperature rise occurs in a non-paper passing area of the heater. When the excessive temperature rise occurs in the non-paper passing area of the fixing roller or the heater, respective parts included in the heat-fixing apparatus may be damaged. Additionally, when the large-size recording material is printed in a state where the excessive temperature rise occurs in the non-paper passing area, the toner on the recording material at the non-paper passing area is melted too much, thereby causing a high-temperature offset.

Particularly, in case of the film heating-type heat-fixing apparatus, since the thermal capacity of the heater is smaller than that of the thermo roller-type heat-fixing apparatus, a large temperature rise occurs in the heater at the non-paper passing area. For this reason, the durability of the pressure roller deteriorates or a high-temperature offset occurs easily. Additionally, the film is rotationally driven in an unstable state, or the film is easily twisted to be wrinkled.

Additionally, as the process speed of the printer becomes faster, the temperature rise occurs easily at the non-paper passing area. This is because the time necessary for the recording material to pass through the nip part becomes short in accordance with an increase in the speed of the printer, and thus the fixing temperature necessary for heat-fixing the toner image onto the recording material should be increased. Also, this is because the paper-interval time during the continuous printing process is reduced in accordance with an increase in the speed of the printer, the paper-interval time indicating a time when the recording material is not interposed in the nip part, and thus the temperature distribution cannot be controlled to be uniform during the paper-interval time.

As one of techniques of reducing the excessive temperature rise at the non-paper passing area, a technique is known which sets the thermal conductivity of the pressure roller to a large value. In terms of this technique in which the thermal conductivity of the elastic layer included in the pressure roller is increased, it is possible to reduce the temperature when the temperature rise occurs at the non-paper passing area, that is, a difference between a high temperature and a low temperature in a longitudinal direction of the pressure roller.

Japanese Patent Application Laid-Open No. H11-116806, Japanese Patent Application Laid-Open No. H11-158377, and Japanese Patent Application Laid-Open No. 2003-208052 disclose a technique in which a high thermal conductive filler, such as alumina, zinc oxide, or silicon carbide, is added to base rubber in order to increase the thermal conductivity of the elastic layer of the pressure roller and the fixing roller.

Japanese Patent Application Laid-Open No. 2002-268423 discloses a technique in which a carbon fiber is contained in an elastic layer in order to increase thermal conductivity of a rotary body (fixing belt instead of pressure roller) having the elastic layer.

Japanese Patent Application Laid-Open No. 2000-39789 discloses a technique in which an anisotropic filler, such as graphite, is contained in an elastomer layer in order to increase the thermal conductivity in a thickness direction of a roller.

Japanese Patent Application Laid-Open No. 2002-351243 discloses a technique in which a fabric layer using pitch-based d carbon fiber is provided in an elastic layer of a pressure roller. The pressure roller includes the elastic layer and a high thermal conductive layer having excellent thermal conductivity. However, since it is a fabric or a structure corresponding thereto, the hardness of the high thermal conductive rubber composite layer increases. Therefore, in a case where the hardness of the pressure roller decreases as a whole, a countermeasure is supposed in which foamed sponge rubber is used as a lower elastic layer. However, since the elastic layer is configured as the foamed sponge rubber, the durability of the pressure roller is not good. For this reason, the pressure roller is suitable for a pressure member mounted to a low-speed image forming apparatus.

Japanese Patent Application Laid-Open No. 2005-273771 corresponding to U.S. Pat. No. 7,321,746 discloses a technique in which pitch-based d carbon fiber is dispersed in an elastic layer of a pressure roller.

Even when the filler, such as alumina, zinc oxide, silicon carbide, carbon fiber, or graphite described in the above-described Patent Documents, is added in order to increase thermal conductivity, it is not possible to obtain the desired thermal conductivity if a small amount of filler is added. On the other hand, if a large amount of filler is added, the hardness of the pressure roller tends to increase too much, and thus it is difficult to ensure the fixing nip width.

In Japanese Patent Application Laid-Open No. 2005-273771 corresponding to U.S. Pat. No. 7,321,746, the thermal conductivity in a longitudinal direction of the pressure roller is excellent, and the hardness of the roller can be appropriately set. However, since the heat transmission from the elastic layer to the metal core is very good, a problem arises in that the surface temperature of the roller decreases too much. In a case where the surface temperature of the pressure roller is too low, vapor produced when the recording material passes through the heating nip part is condensed in the surface of the pressure roller, thereby causing a problem in that the recording material is conveyed in an unstable state.

Therefore, it may be supposed that the elastic layer is formed into a two-layer structure and the outer elastic layer is configured as a high thermal conductive layer.

However, even in case of the two-layer elastic layer, the center nip width of the nip part is narrower than the end-portion nip width thereof in a longitudinal direction of the pressure roller. Accordingly, upon heat-fixing the unfixed toner image onto the recording material, fixability at the center of the nip part may be not sufficient, or fixability at the end portion of the nip part may be excessive.

SUMMARY OF THE INVENTION

The present invention is contrived in consideration of the above-described problems, and an object of the invention is to provide an image heating apparatus and a pressure roller used in the image heating apparatus, the pressure roller having good thermal conductivity in an axial direction and being capable of forming a nip part having an appropriate width together with a heating member in an axial direction.

Another object of the invention is to provide An image heating apparatus including a heating member; and a pressure roller that contacts the heating member, the pressure roller including a metal core, a first elastic layer, and a second elastic layer provided on the outside of the first elastic layer, the second elastic layer having a thermal conductivity higher than a thermal conductivity of the first elastic layer, wherein a recording material bearing a toner image thereon is pinched and conveyed between the heating member and the pressure roller so as to be heated, and wherein each of end portions of the second elastic layer is thicker than a center portion of the second elastic layer in an axial direction of the pressure roller.

Still another object of the invention is to provide a pressure roller including a metal core, a first elastic layer; and a second elastic layer provided on the outside of the first elastic layer, the second elastic layer having a thermal conductivity higher than a thermal conductivity of the first elastic layer, wherein each of end portions of the second elastic layer is thicker than a center portion of the second elastic layer in an axial direction of the pressure roller.

Further features of the present invention will become apparent from the following description of exemplary embodiments with reference to the attached drawings.

DESCRIPTION OF THE EMBODIMENTS

The present invention will be described with reference to the accompanying drawings.

(1) Example of Image Forming Apparatus

Figure 1:
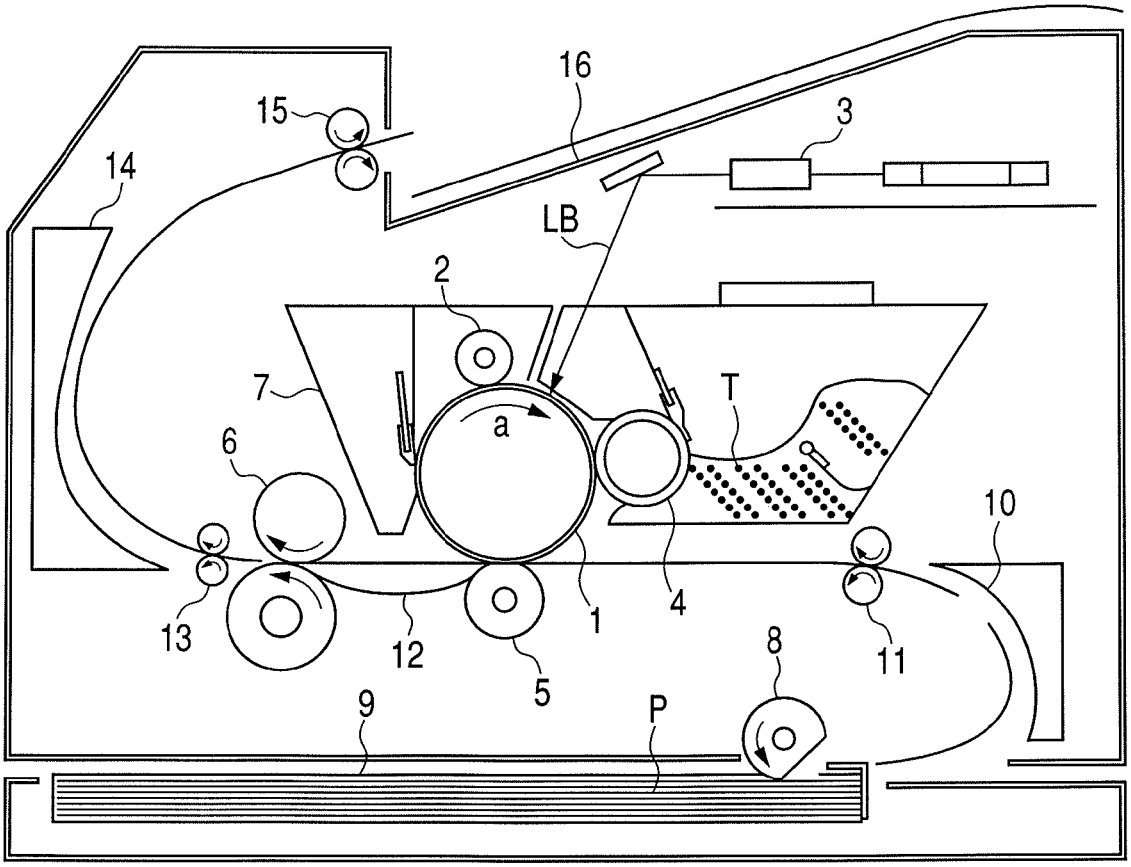
FIG. 1 is a schematic configuration diagram illustrating an example of an image forming apparatus.

FIG. 1 is a schematic configuration diagram illustrating an example of an image forming apparatus in which an image heating apparatus according to the invention can be used as a heat-fixing apparatus. The image forming apparatus is an electrophotographic laser beam printer.

The printer illustrated in the present embodiment includes a rotary drum-type electrophotographic photosensitive member (hereinafter, referred to as a photosensitive drum) 1 as an image bearing member. The photosensitive drum 1 has a structure in which a photosensitive material layer, such as OPC, amorphous Se, or amorphous Si, is formed on the outer-peripheral surface of a cylindrical (drum-shape) conductive base, such as aluminum or nickel.

The photosensitive drum 1 is rotationally driven at a predetermined circumferential speed (process speed) in a clockwise direction indicated by the arrow a, and the outer-peripheral surface (surface) of the photosensitive drum 1 is uniformly charged by a charger roller 2 as a charger so as to have predetermined polar potential during the rotation. A scanning exposure operation using a laser beam LB output from a laser beam scanner 3 and controlled to be tuned on or off in accordance with image information is performed on the uniformly charged surface of the photosensitive drum 1. Accordingly, an electrostatic latent image in accordance with the target image information is formed on the surface of the photosensitive drum 1.

The latent image is visualized by a developer device 4 as a developer using a toner T. As a developing method, a jumping developing method, a two-component developing method, an FEED developing method, or the like is used, and such a developing method is used in combination of image exposure and reversal development in many cases.

Meanwhile, a recording material P stacked in a cassette 9 is fed one sheet by one sheet by driving a feeding roller 8 so as to be conveyed to a registration roller 11 via a sheet path provided with a guide 10 and the registration roller 11. The registration roller 11 feeds the recording material P to a transfer nip part T between the outer-peripheral surface of a transferring roller 5 and the surface of the photosensitive drum 1 at predetermined timing. The recording material P is pinched and conveyed to the transfer nip part T. During the conveying process, a toner image formed on the surface of the photosensitive drum 1 is sequentially transferred onto the surface of the recording material P by the use of transfer bias applied to the transferring roller 5. Accordingly, the recording material P carries an unfixed toner image thereon.

The recording material P bearing the unfixed toner image thereon is sequentially separated from the surface of the photosensitive drum 1 to be discharged from the transfer nip part T, and is introduced into a nip part N of a heat-fixing apparatus 6 via a conveying guide 12. Heat and pressure of the nip part N of the heat-fixing apparatus 6 are applied to the recording material P so that the toner image is heat-fixed onto the surface of the recording material P.

The recording material P discharged from the fixing apparatus 6 is printed-out to a discharging tray 16 via a sheet path provided with a conveying roller 13, a guide 14, and a discharging roller 15.

Additionally, after the recording material is separated from the photosensitive drum 1, the surface of the photosensitive drum 1 is subjected to a process in which adsorbed contaminant, such as remaining toner, is removed by a cleaning device 7 as a cleaner. Accordingly, the surface is cleaned and is used to form an image thereon.

The printer according to the present embodiment is a printer for A3 size paper, and has a print speed of 50 sheets/min (A4 transverse). Additionally, a toner having a glass-transition temperature of 55 to 65° C. is used which mainly includes styrene acrylic resin. Also, if necessary, a charge control agent, magnetic material, silica, or the like may be internally or externally added to styrene acrylic resin.

(2) Fixing Apparatus (Image Heating Apparatus)

Hereinafter, a fixing apparatus and a member constituting the fixing apparatus will be described. A longitudinal direction indicates a direction perpendicular to a recording material conveyance direction in a surface of the recording material. A short-length direction indicates a direction parallel to a recording material conveyance direction in the surface of the recording material. A width indicates a dimension in a short-length direction.

Figure 2:
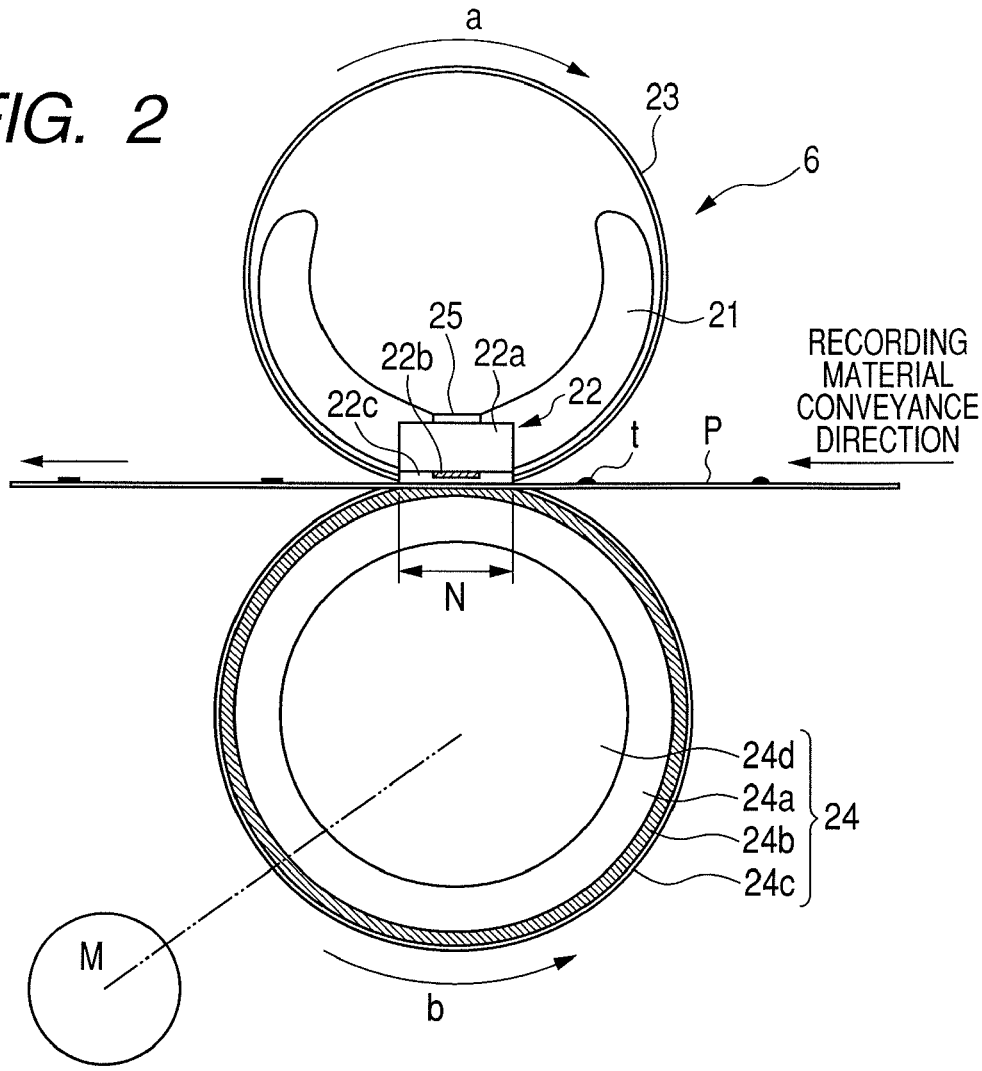
FIG. 2 is a schematic configuration diagram illustrating a fixing apparatus.

FIG. 2 is a schematic configuration diagram illustrating a fixing apparatus 6. The fixing apparatus 6 is a film heating-type heat-fixing apparatus.

Reference numeral 21 denotes a film guide member (stay) which has a transverse section formed in a substantially semi-circular arc and a gutter shape and is transversely long in a longitudinal direction corresponding to a direction perpendicular to the drawing. Reference numeral 22 denotes a transversely extended heater which is received and held in a groove substantially formed at the center of the lower surface of the film guide member 21 in a longitudinal direction. Reference numeral 23 denotes a flexible member as a heating member. The flexible member 23 denotes an endless belt-type (cylindrical) heat resistant film (flexible sleeve) loosely fitted to the outside of the film guide member 21 attached with the heater. In the present embodiment, components such as the heater 22 and the film 23 for heating the toner image are referred to in total as a heating member.

Reference numeral 24 denotes a transversely extending elastic pressure roller as a pressure member brought into press-contact with the lower surface of the heater 22 with the film 23 interposed therebetween. N denotes a nip part (fixing nip part) formed between the heater 22 and the pressure roller 24, in which the nip part is formed by elastic deformation generated when an elastic high thermal conductive elastic layer 24*b* and an elastic layer 24*a* of the pressure roller 24 are brought into contact with the heater 22 with the film 23 interposed therebetween. The pressure roller 24 is rotationally driven in a counter-clockwise direction indicated by the arrow b at a predetermined circumferential speed upon receiving a driving force output from a driving source M via a power transmission mechanism such as a gear (not shown).

The film guide member 21 is, for example, a molded part formed of thermal resistant resin such as liquid polymer or PPS (polyphenylene sulfide).

The heater 22 is a ceramic heater having low thermal capacity as a whole. The heater 22 illustrated in the present embodiment includes a heater substrate 22*a* such as alumina formed in a transversely long thin plate shape and an electrically conductive heater (resistance heater) 22*b* such as Ag/Pd formed in a surface (film sliding surface) in a longitudinal direction with a linear shape or a narrow band shape. Additionally, the heater 22 includes a thin surface protection layer 22*c*, such as a glass layer, for covering and protecting the electrically conductive heater 22*b*. Then, a temperature measuring element 25, such as a thermistor, is provided on the opposite surface of the heater substrate 22*a*. A temperature of the heater 22 promptly increases upon supplying power to the electrically conductive heater 22*b*, and the heater 22 is controlled at a predetermined fixing temperature (target temperature) by a power control system (not shown) including the temperature measuring element 25.

In order to improve quick-start performance by decreasing the thermal capacity of the film 23, the film 23 is configured as a single layer film having a film thickness of 100 μm or less as a whole and desirably in the range of 20 μm to 60 μm or a composite layer film in which a mold release layer is coated on a surface of a base film. As material of the single layer film, PTFE (polytetrafluoroethylene), PFA (tetrafluoroethylene-perfluoroalkylvinylether), PPS or the like having heat resistant property, releasing property, strength, and durability is used. As material of the base film, polyimide, polyamideimide, PEEK (polyetheretherketone), PES (polyethersulfone), or the like is used. As material of the mold release layer, PTFE, PFA (tetrafluoroethylene-perfluoro alkyl vinyl ether), FEP, or the like is used.

The pressure roller 24 includes a metal core 24*d* formed of iron or aluminum, a solid rubber elastic layer 24*a*, a high thermal conductive elastic layer 24*b*, and a mold release layer 24*c* formed of material and a formation method is described in detail in point (3) below. The pressure roller 24 is configured such that the surface of the pressure roller 24 applies a predetermined pressing force to the surface protection layer 22*c* of the heater 22 with the film 23 interposed therebetween. In accordance with the pressing force, the high thermal conductive elastic layer 24*b* of the pressure roller 24 is elastically deformed, and the nip part N having a predetermined width is formed between the surface of the film 23 and the surface of the pressure roller 24.

The film 23 rotates together with the rotation of the pressure roller 24 when the pressure roller 24 rotates in a counter-clockwise direction indicated by the arrow b during at least the image forming process. That is, when the pressure roller 24 is rotationally driven, a rotary force acts on the film 23 at the nip part N in terms of a friction force between the outer-peripheral surface of the pressure roller 24 and the outer-peripheral surface of the film 23. When the film 23 rotates, the inner-peripheral surface (inner surface) of the film 23 slides on the surface protection layer 22*c* of the heater 22 at the nip part N. In this case, in order to reduce a sliding friction force between the inner surface of the film 23 and the surface protection layer 22*c* of the heater 22, lubricant such as thermal resistant grease may be interposed therebetween.

Accordingly, when the film 23 rotates together upon rotationally driving the pressure roller 24 and the heater 22 is maintained at a predetermined fixing temperature, the recording material P bearing an unfixed toner image t is introduced into the nip part N. At the nip part N, the recording material P is conveyed while being interposed between the surface of the film 23 and the surface of the pressure roller 24. During the conveying process, the heat of the heater 22 is applied to the toner image t via the film 23, and nip pressure of the nip part N is applied thereto. Accordingly, the toner image t is heat-fixed onto the surface of the recording material P. The recording material P discharged from the nip part N is separated from the surface of the film 23 and is discharged from the fixing apparatus 6.

Since the film heating-type heat-fixing apparatus 6 according to the present embodiment includes the heater 22 which has low thermal capacity and in which a temperature promptly increases, it is possible to remarkably reduce the time for the heater 22 to arrive at the predetermined fixing temperature. For this reason, it is possible to easily increase the temperature of the heater 22 up to the high-temperature fixing temperature from a room temperature. Accordingly, since it is not necessary to control the temperature of the fixing apparatus 6 in a standby state during a non-printing process, it is possible to save power.

Additionally, in order that a tension is not substantially applied to the rotating film 23 at a part other than the nip part N and the fixing apparatus 6 is simplified, only a flange member (not shown) is provided as a film movement regulator so as to just support the end portion of the film 23.

(3) Pressure Roller 24

Hereinafter, material forming the pressure roller 24 and a method of forming the pressure roller 24 will be described in detail.

3-1) Layer Structure of Pressure Roller 24

Figure 3:
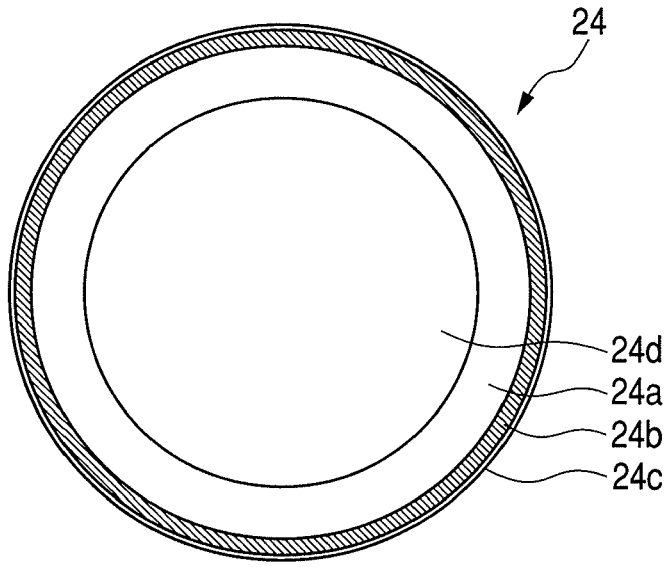
FIG. 3 is a configuration diagram illustrating a layer structure of a pressure roller.

FIG. 3 is a configuration diagram illustrating a layer structure of the pressure roller 24.

The pressure roller 24 illustrated in the present embodiment includes the solid rubber elastic layer (thermal resistant rubber layer) 24*a* as a first elastic layer having a thermal conductivity and provided in the outer periphery of the round metal core 24*d*. Then, the pressure roller 24 includes the elastic layer 24*b* as a second elastic layer having higher thermal conductivity than that of the solid rubber elastic layer 24*a* and provided in the outer periphery of the solid rubber elastic layer 24*a*. Hereinafter, the elastic layer 24*b* is referred to as high thermal conductive elastic layer. Additionally, the pressure roller 24 includes the mold release layer 24*c* provided in the outer periphery of the high thermal conductive elastic layer 24*b*. That is, the pressure roller 24 includes at least the solid rubber elastic layer 24*a* as the first elastic layer and the high thermal conductive elastic layer 24*b* as the second elastic layer.

The solid rubber elastic layer 24*a* is formed of flexible and thermal resistant material represented as silicone rubber.

The high thermal conductive elastic layer 24*b* is obtained in such a manner that rubber formed of flexible and thermal resistant material represented as silicone rubber contains thermal conductive filler. Accordingly, it is possible to improve the thermal flow in the surface of the pressure roller 24 so that the thermal flow in a longitudinal direction perpendicular to a recording material conveyance direction (FIG. 2) is larger than the thermal flow in a direction different from a longitudinal direction.

The mold release layer 24*c* is formed in the surface of the pressure roller represented as fluorine resin or fluorine rubber by the use of appropriate material.

The solid rubber elastic layer 24*a*, the high thermal conductive elastic layer 24*b*, and the mold release layer 24*c* will be described in detail.

3-1-1) Solid Rubber Elastic Layer 24*a*

A total thickness of the whole elastic layers of the solid rubber elastic layer 24*a* and the high thermal conductive elastic layer 24*b* used in the pressure roller 24 is not particularly limited so long as the thickness is sufficient for forming the nip part N having a desired width, but it is desirable that the thickness is in the range of 2 to 10 mm. The thickness of the solid rubber elastic layer 24*a* is not particularly limited, but the necessary thickness may be appropriately adjusted in consideration of hardness of the high thermal conductive elastic layer 24*b* described in detail in the next paragraph. Here, the thickness indicates a dimension of the pressure roller 24 in a radial direction.

As the solid rubber elastic layer 24*a*, general thermal resistant solid rubber elastic material, such as silicone rubber or fluorine rubber, may be used. All materials have sufficient thermal resistant property and durability and have desirable elasticity (flexibility) in application to the fixing apparatus 6. Accordingly, the silicone rubber or the fluorine rubber is suitable for the main material of the solid rubber elastic layer 24*a*.

Additionally, the silicone rubber or the fluorine rubber may contain a compounding agent within a degree that the action of the high thermal conductive elastic layer 24*b* is not largely changed. A typical example of the silicone rubber includes an addition reaction-type dimethylsilicone rubber obtained by a rubber crosslink of demethylpolysiloxane according to addition reaction between a vinyl group and a silicon-bonded hydrogen group. A typical example of the fluorine rubber includes a binary radical reaction-type fluorine rubber obtained by a rubber crosslink by a radical reaction of peroxide using binary copolymer of vinylidenefluoride and hexafluoropropylene as base polymer. Additionally, a typical example of the fluorine rubber includes a ternary radical reaction-type fluorine rubber obtained by a rubber crosslink by a radical reaction of peroxide using ternary copolymer of vinylidenefluoride, hexafluoropropylene, and tetrafluoroethylene as base polymer.

A method of forming the solid rubber elastic layer 24*a* is not particularly limited, but a general formation method may be appropriately used.

3-1-2) High Thermal Conductive Elastic Layer 24*b*

The high thermal conductive elastic layer 24*b* having a predetermined thickness is formed in the outer periphery of the solid rubber elastic layer 24*a*. If the thickness of the high thermal conductive elastic layer 24*b* is within the range described in Clause 3-1-1, the high thermal conductive elastic layer 24*b* having an arbitrary appropriate thickness can be used for the pressure roller 24. The high thermal conductive elastic layer 24*b* is formed in such a manner that thermal conductive filler such as alumina, AlN (aluminum nitride), or carbon fiber is formed in thermal resistant elastic material 24*e* in a dispersed state in order to increase thermal conductivity.

In the same manner as the solid rubber elastic layer 24*a*, thermal resistant rubber material, such as silicone rubber or fluorine rubber, can be used as the thermal resistant elastic material 24*e*. In a case where the silicone rubber is used as the thermal resistant elastic material 24*e*, addition type silicone rubber is preferred from the viewpoint of whether it is easy to be obtained and to be processed. Additionally, when the viscosity of raw material rubber is too low before curing the raw material rubber, the liquid being viscous. On the other hand, when viscosity of the raw material rubber is too high, it is difficult to mix and disperse the raw material rubber. For this reason, it is desirable to use raw material rubber having viscosity of 0.1 to 1,000 Pa·s.

A carbon fiber 24*f* serves as filler for ensuring thermal conductivity of the high thermal conductive elastic layer 24*b*. When the carbon fiber 24*f* is dispersed in the thermal resistant elastic material 24*e*, it is possible to form a thermal passageway. Accordingly, it is possible to realize efficient thermal dispersion from a high-temperature side such as a non-paper passing area of the heater 22 to a paper passing area. Additionally, since the carbon fiber 24*f* is formed in a thin and long fiber shape (needle shape), when the carbon fiber 24*f* in a liquid state mixes with the thermal resistant elastic material 24*e*, it is easy to align the carbon fiber 24*f* in a flow direction, that is, a longitudinal direction of the solid rubber elastic layer 24*a* during the forming process. For this reason, it is possible to improve thermal conductivity in a longitudinal direction of the high thermal conductive elastic layer 24*b*.

Next, an alignment of the carbon fiber 24*f* in the high thermal conductive elastic layer 24*b* will be described in detail.

Figure 4A:
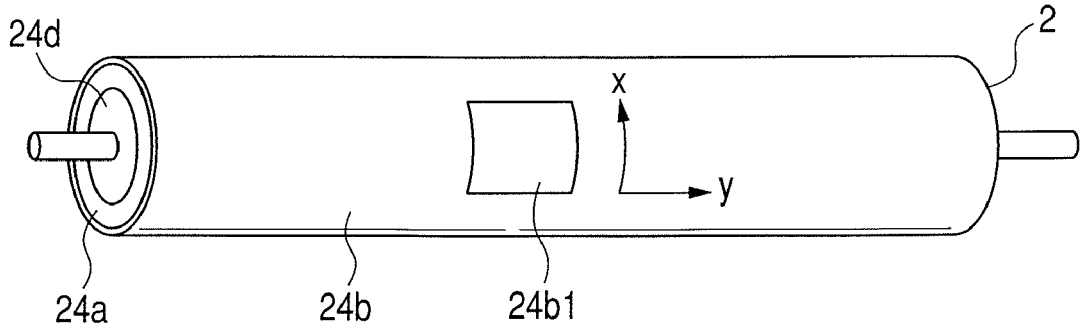
FIG. 4A is a perspective diagram illustrating an elastic formative member 2 of the pressure roller.
Figure 4B:
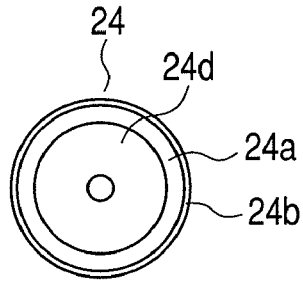
FIG. 4B is a cross-sectional diagram illustrating the pressure roller.
Figure 5:
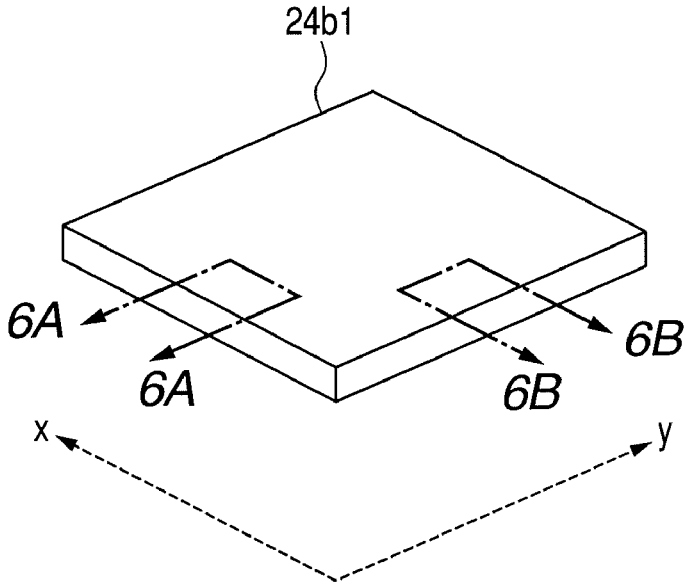
FIG. 5 is an enlarged perspective diagram illustrating a cutout sample of a high thermal conductive elastic layer of the elastic formative member 2 of the pressure roller.
Figure 6A:
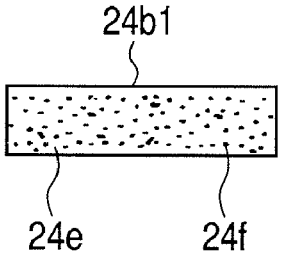
FIG. 6A is an enlarged cross-sectional diagram illustrating the cutout sample of the high thermal conductive elastic layer illustrated in FIG. 5 when taken along the line 6A-6A in FIG. 5.
Figure 6B:
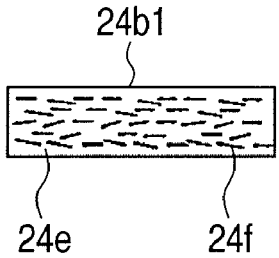
FIG. 6B is an enlarged cross-sectional diagram illustrating the cutout sample of the high thermal conductive elastic layer illustrated in FIG. 5 when taken along the line 6B-6B in FIG. 5.
Figure 7:
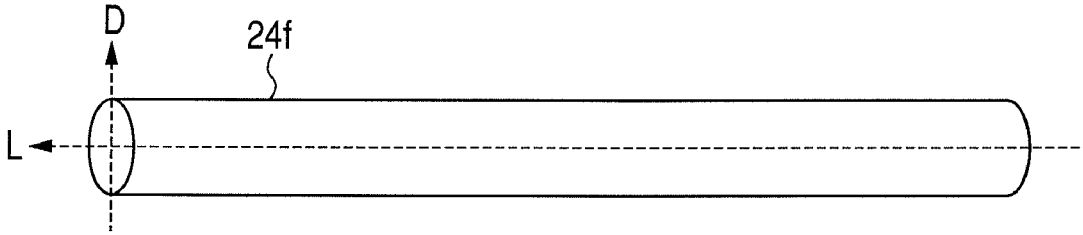
FIG. 7 is an explanatory diagram illustrating a carbon fiber.

FIG. 4A is an entire perspective diagram illustrating an elastic formative member 2 in which the high thermal conductive elastic layer 24*b* is formed in the outer periphery of the slide rubber elastic layer 24*a* on the metal core 24*d*. FIG. 4B is a right side diagram illustrating the elastic formative member 2 illustrated in FIG. 4A. FIG. 5 is an enlarged perspective diagram illustrating a cutout sample 24*b*1 of the high thermal conductive elastic layer 24*b* of the elastic formative member 2 illustrated in FIG. 4A. FIG. 6A is an enlarged cross-sectional diagram illustrating the cutout sample 24*b*1 when taken along the line 6A-6A shown in FIG. 5. FIG. 6B is an enlarged cross-sectional diagram illustrating the cutout sample 24*b*1 when taken along the line 6B-6B shown in FIG. 5. FIG. 7 is an explanatory diagram illustrating a fiber length portion L and a fiber diameter portion D of the carbon fiber 24*f*.

As illustrated in FIG. 4A, in the elastic formative member 2 in which the high thermal conductive elastic layer 24*b* is formed in the outer periphery of the solid rubber elastic layer 24*a* on the metal core 24*d*, the high thermal conductive elastic layer 24*b* is cutout in the x direction (circumferential direction) and the y direction (longitudinal direction). Then, in the cutout sample 24*b*1 of the high thermal conductive elastic layer 24*b*, as shown in FIG. 5, a section in the x direction and a section in the y direction are observed, respectively. In a section in the x direction, the fiber diameter portion D (see FIG. 7) of the carbon fiber 24*f* is mainly observed as shown in FIG. 6A. On the contrary, in b section in y direction taken along the line 6B-6B, the fiber length direction L (see FIG. 7) of the carbon fiber 24*f* is mainly observed as shown in FIG. 6B.

Meanwhile, regarding spherical filler, such as alumina or AlN, the dispersed state is uniform in a section in the x direction and a section in y direction. Accordingly, filler such as alumina or AlN does not have anisotropic thermal conductivity.

Here, in the carbon fiber 24*f*, when an average of the fiber length portion L is shorter than 10 μm, it is difficult to obtain anisotropic thermal conductivity in the high thermal conductive elastic layer 24*b*. That is, when thermal conductivity of the high thermal conductive elastic layer 24*b* is high in a longitudinal direction, but low in a circumferential direction, it is possible to supply thermal capacity to the center in a longitudinal direction of the high thermal conductive elastic layer 24*b*. Accordingly, it is possible to obtain uniform fixing property of the toner image t carried by the recording material P and to thus save power. Additionally, it is possible to reduce a temperature rise in the non-paper passing area in a longitudinal direction of the pressure roller 24. When the average of the fiber length portion L is longer than 1 mm, it is difficult to disperse the carbon fiber 24*f* in the high thermal conductive elastic layer 24*b*. Accordingly, the length of the carbon fiber 24*f* is in the range of 0.01 mm to 1 mm, and desirably in the range of 0.05 mm to 1 mm.

As the carbon fiber 24*f*, it is desirable to use pitch-based carbon fiber made from petroleum pitch or coal pitch from the viewpoint of thermal conductivity.

3-1-3) Mold Release Layer 24*c*

The mold release layer 24*c* may be formed by covering an PFA tube on the high thermal conductive elastic layer 24*b* or by coating fluorine rubber or fluorine resin such as PTFE, PFA, or FEP on the high thermal conductive elastic layer 24*b*. Additionally, the thickness of the mold release layer 24*c* is not particularly limited if the thickness is sufficient for applying sufficient releasing property to the pressure roller 24, but the thickness is preferably in the range of 20 to 100 μm.

In consideration of objects such as adhering and current supplying, a primary layer or an adhesive layer may be formed between the solid rubber elastic layer 24*a* and the high thermal conductive elastic layer 24*b* or between the high thermal conductive elastic layer 24*b* and the mold release layer 24*c*. Additionally, each layer may have a multi-layer structure within the scope of the invention. In consideration of objects of such as sliding property, heating property, and releasing property, the pressure roller 24 may be provided with other layers instead of the layers described above. A sequence of forming the layers is not particularly limited, but may be appropriately changed in consideration of the respective processes.

3-2) Embodiments of Pressure Roller 24

Embodiment 1

Figure 8:
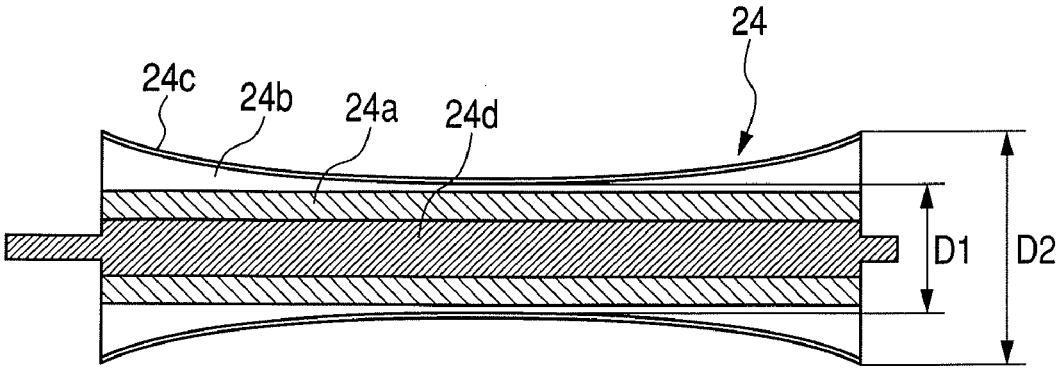
FIG. 8 is a longitudinal cross-sectional diagram illustrating an example of the pressure roller according to Embodiment 1.
Figure 9:
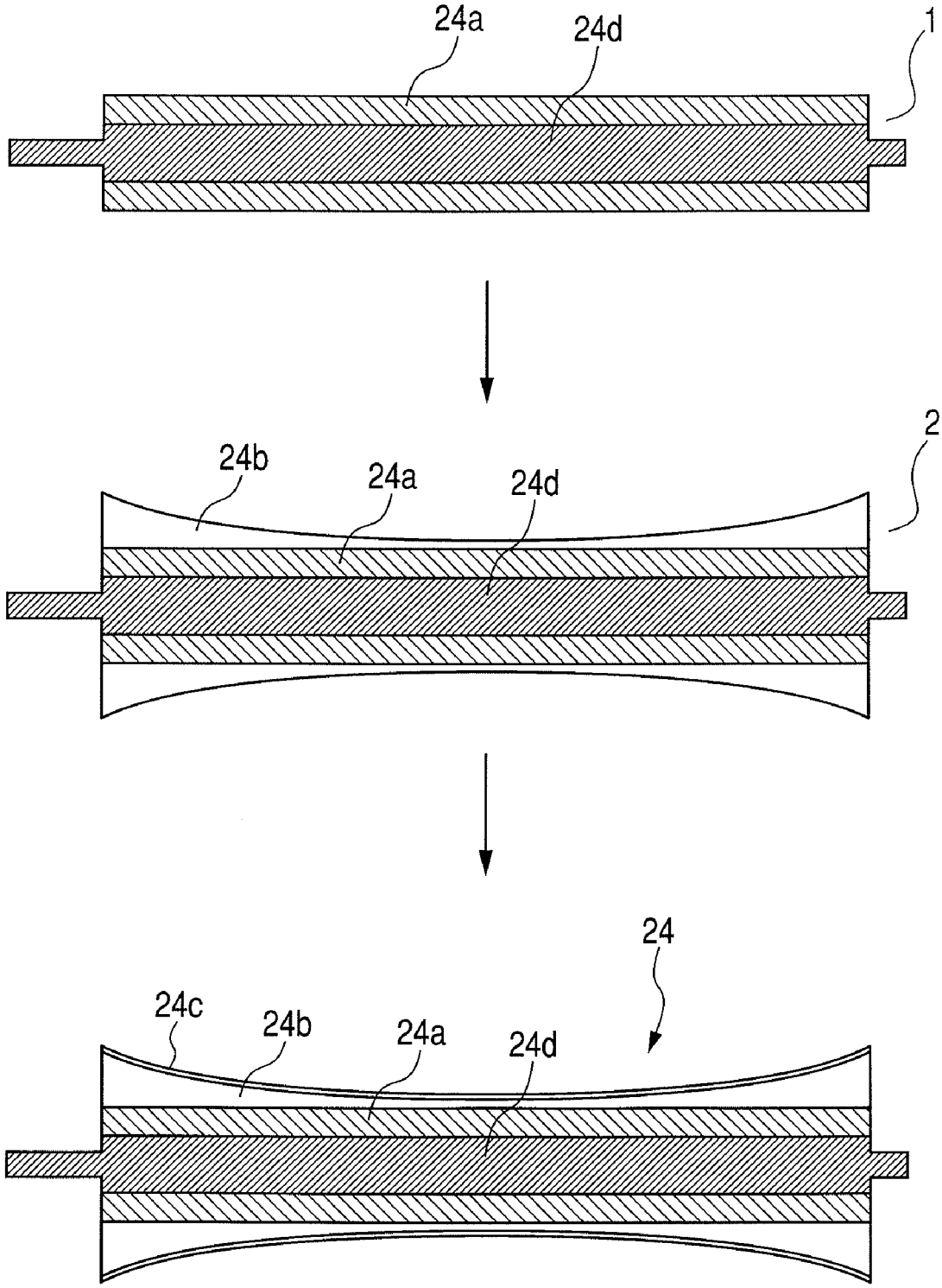
FIG. 9 is an explanatory diagram illustrating a sequence of forming the pressure roller according to Embodiment 1.

FIG. 8 is a longitudinal sectional diagram illustrating an example of the pressure roller 24 according to Embodiment 1. FIG. 9 is an explanatory diagram illustrating a sequence of forming the pressure roller 24 illustrated in FIG. 8.

In the pressure roller 24 according to Embodiment 1, the pressure roller 24 is formed in an inversed crown shape, in which the elastic layer is formed from a combination of the solid rubber elastic layer 24*a* and the high thermal conductive elastic layer 24*b*, so that an end-portion thickness of the high thermal conductive elastic layer 24*b* in a longitudinal direction is larger than a center thickness thereof.

The solid rubber elastic layer 24*a* and the high thermal conductive elastic layer 24*b* of the pressure roller 24 according to Embodiment 1 and a method of forming them will be described.

<Solid Rubber Elastic Layer 24*a*>

An addition reaction curing-type silicone rubber having density of 1.20 g/cm$^3$ is used as the solid rubber elastic layer 24*a*.

<High Thermal Conductive Elastic Layer 24*b*>

Next, the high thermal conductive elastic layer 24*b* will be described.

In a condition where weight-average molecular weight Mw=65,000, the number average molecular weight Mn=15,000, the A liquid has a vinyl group density (0.863 mol %), an SiH density (none), and a viscosity (7.8 Pa·s), the B liquid has a vinyl group density (0.955 mol %), an SiH density (0.780 mol %), the viscosity (6.2 Pa·s), and A/B=1/1, the A liquid and the B liquid satisfying the formula H/Vi=0.43 are mixed at the ratio of 1:1, and a platinum compound of a catalyst is added thereto, thereby obtaining addition curing-type silicone rubber undiluted solution.

Alumina, AlN, and pitch based carbon fiber is uniformly mixed with the addition curing-type silicone rubber undiluted solution at a predetermined volume ratio, thereby obtaining silicone rubber composite (not shown). The silicone rubber composite is used as the high thermal conductive elastic layer 24*b*.

<Method of Forming Pressure Roller 24>

The solid rubber elastic layer 24*a* having a thickness of 3 mm is formed on the outer periphery of the aluminum metal core 24*d* having ϕ22 (mm) by the use of the silicone rubber and the formation method, thereby obtaining the elastic formative member 1 shown in FIG. 9. An external shape of the elastic formative member 1 has ϕ28 (mm). Here, a heating and curing process is carried out at 150° C. for thirty minutes. The thermal conductivity λ of the solid rubber elastic layer 24*a* is 0.2 W/(m·K), and the test piece hardness is 32 in ASKER-C hardness. The thermal conductivity of 0.2 W/(m·K) is lower than those of the high thermal conductive elastic layers 24*b* according to Comparative Examples 1 to 6 described below.

Next, the elastic formative member 1 having ϕ28 is set at a die (not shown) having an inner diameter of ϕ30 (mm) so that an axis of the die is identical with an axis of the metal core 24*d* of the elastic formative member 1. Then, silicone rubber composite 1 is injected between the die and the elastic formative member 1, and a heating and curing process is carried out at 150° C. for sixty minutes, thereby obtaining an elastic formative member 2 provided with the high thermal conductive elastic layer 24*b* having an outer diameter of ϕ30 (mm) (see FIG. 9). In the forming process of the high thermal conductive elastic layer 24*b*, the high thermal conductive elastic layer 24*b* is formed in an inversed crown shape having an inversed crown amount of 200 μm so that an end-portion thickness in a longitudinal direction is larger than a center thickness. That is, a thickness of the high thermal conductive elastic layer 24*b* changes as the second elastic layer changes from the center to the end portion thereof in a longitudinal direction of the high thermal conductive elastic layer 24*b*.

Then, a PFA tube having a thickness of 30 μm as the mold release layer 24*c* is coated on the outer periphery of the high thermal conductive elastic layer 24*b* of the elastic formative member 2, and both end portions are cut, thereby obtaining the pressure roller 24 having a length of 320 mm in a longitudinal direction. Here, PFA is tetrafluoroethylene/perfluoroalkylvinylether copolymer.

In the pressure roller 24 according to Embodiment 1, the high thermal conductive elastic layer 24*b* is formed in an inversed crown shape having an inversed crown amount of 200 μm, thereby forming the inversed crown shape of 200 μm in the pressure roller 24. Here, the inversed crown amount indicates a difference between an end-portion outer diameter D2 and a center outer diameter D1 of the pressure roller 24 in a longitudinal direction (D2-D1). Accordingly, the inversed crown amount of 200 μm is a difference between D2 and D1. In FIGS. 8 and 9, in order to easily understand the external inversed crown shape of the pressure roller 24, the external shape of the pressure roller 24 is highlighted.

Accordingly, in the pressure roller 24 according to Embodiment 1, the elastic layer is formed as a combination of the high thermal conductive elastic layer 24*b* and the solid rubber elastic layer 24*a* as the first elastic layer so that the end-portion thickness of the high thermal conductive elastic layer 24*b* as the second elastic layer in a longitudinal direction is larger than the center thickness thereof.

Embodiment 2

Figure 10:
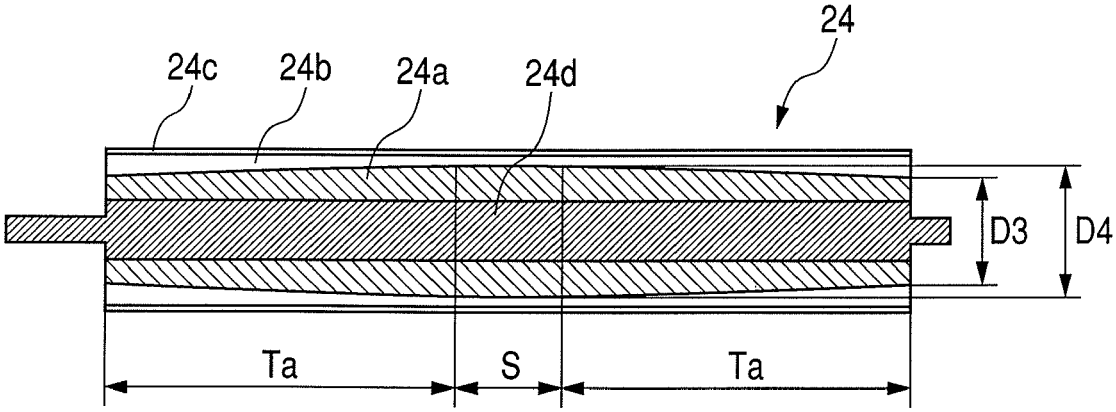
FIG. 10 is a longitudinal sectional diagram illustrating an example of the pressure roller according to Embodiment 2.
Figure 11:
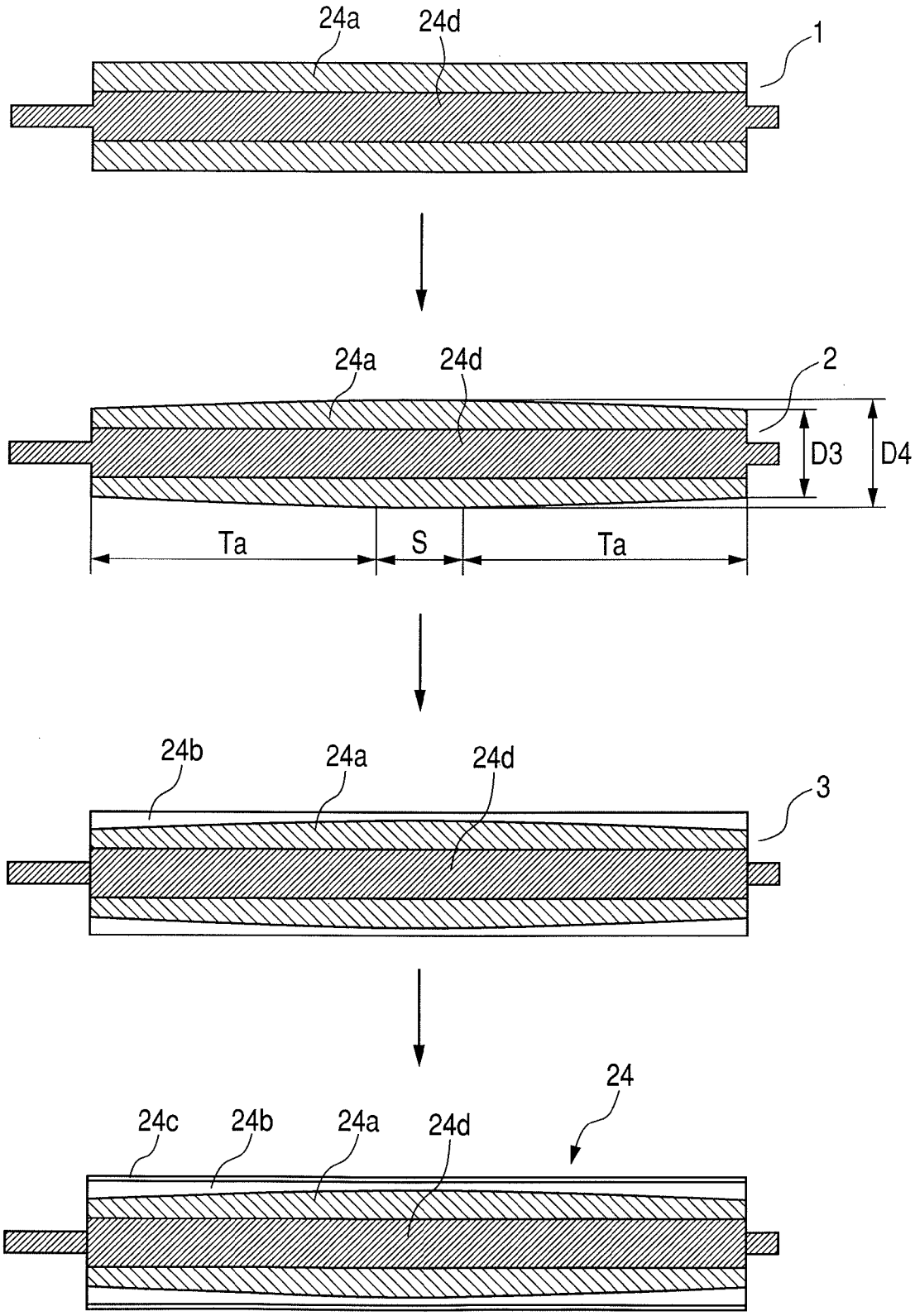
FIG. 11 is an explanatory diagram illustrating a sequence of forming the pressure roller 24 shown in FIG. 10 according to Embodiment 2.

FIG. 10 is a longitudinal sectional diagram illustrating an example of the pressure roller 24 according to Embodiment 2. FIG. 11 is an explanatory diagram illustrating a sequence of forming the pressure roller 24 illustrated in FIG. 10.

In the pressure roller 24 according to Embodiment 2, the pressure roller 24 is formed in a straight shape, in which the elastic layer is formed as a combination of the solid rubber elastic layer 24*a* and the high thermal conductive elastic layer 24*b* so that an end-portion thickness of the high thermal conductive elastic layer 24*b* in a longitudinal direction is larger than a center thickness thereof.

<Method of Forming Pressure Roller 24>

The solid rubber elastic layer 24*a* is formed on the outer periphery of the metal core 24*d* by the use of the silicone rubber and the formation method, thereby obtaining the elastic formative member 1 shown in FIG. 11. The material, thickness, temperature condition, and the like of the solid rubber elastic layer 24*a* are the same as those of the solid rubber elastic layer 24*a* of the pressure roller 24 according to Embodiment 1.

In the outer periphery of the solid rubber elastic layer 24*a* of the elastic formative member 1, a polishing process is performed to Ta areas on both end portions of the solid rubber elastic layer 24*a* in a longitudinal direction, thereby obtaining the elastic formative member 2 formed in a taper shape having a taper amount of 1 mm at the Ta regions. The taper amount indicates a difference between a center outer shape D4 and an end-portion outer shape D3 of the solid rubber elastic layer 24*a* in a longitudinal direction (D4-D3). Accordingly, a crown amount of 1 mm is the difference between D4 and D3. In the outer periphery of the solid rubber elastic layer 24*a* of the elastic formative member 1, S area at the center between the Ta areas of the solid rubber elastic layer 24*a* in a longitudinal direction is formed in a straight shape so as to be parallel to an axis of the metal core 24*d*. Accordingly, the solid rubber elastic layer 24*a* is formed in a crown shape in which the thickness of the solid rubber elastic layer 24*a* at the center in a longitudinal direction is thicker than the thickness of the solid rubber elastic layer 24*a* at the end portion thickness in a longitudinal direction. That is, the thickness of the solid rubber elastic layer 24*a* changes as the first elastic layer changes from the center to the end portion of the solid rubber elastic layer 24*a*. In FIGS. 10 and 11, in order to easily understand the taper shape of the solid rubber elastic layer 24*a*, the external shape of the solid rubber elastic layer 24*a* is highlighted.

Then, the high thermal conductive elastic layer 24*b* is formed in the outer periphery of the solid rubber elastic layer 24*a* of the elastic formative member 2 by the use of the formation method, thereby obtaining elastic formative member 3 formed in a straight shape to be parallel to the axis of the metal core 24*d*.

Then, a PFA tube having a thickness of 30 μm as the mold release layer 24*c* is coated on the outer periphery of the high thermal conductive elastic layer 24*b* of the elastic formative member 3, and both end portions are cut, thereby obtaining the pressure roller 24 having a length of 320 mm in a longitudinal direction.

Accordingly, even in the pressure roller 24 according to Embodiment 2, the elastic layer is formed in combination of the high thermal conductive elastic layer 24*b* and the solid rubber elastic layer 24*a* as the first elastic layer so that the thickness of the high thermal conductive elastic layer 24*b* at the end-portion as the second elastic layer in a longitudinal direction is thicker than the thickness of the high thermal conductive elastic layer 24*b* at the center portion.

3-3) Evaluation of Pressure Roller 24

The pressure roller 24 is evaluated by comparing the performance of the rollers according to Comparative Examples 1 to 6 with the performance of the rollers according to Examples 1 to 6 described in below. Here, the rollers according to Comparative Examples 1 to 6 have the same reference numerals as those of the rollers according to Examples 1 to 6 and have the elastic layers having the same properties.

3-3-1) Description of Rollers According to Comparative Examples 1 to 6

Figure 12:
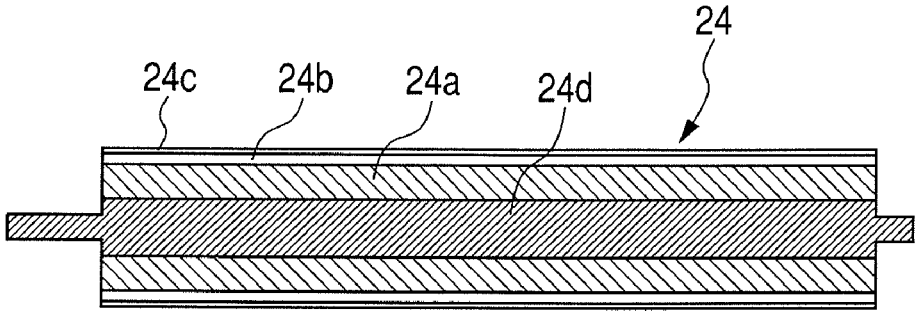
FIG. 12 is a longitudinal sectional diagram illustrating the rollers according to Comparative Examples 1 to 6.

FIG. 12 is a longitudinal sectional diagram illustrating the rollers according to Comparative Examples 1 to 6.

In the rollers according to Comparative Examples 1 to 6, a metal core 24*d* made of iron whose diameter is ϕ22 (mm) is used, a total thickness of the solid rubber elastic layer 24*a* and the high thermal conductive elastic layer 24*b* is set by 4 mm, and the pressure roller 24 whose outer diameter is ϕ30 (mm) is used. A thickness of the high thermal conductive elastic layer 24*b* is 1 mm. A PFA tube having a thickness of 30 μm is used as the mold release layer 24*c*. Additionally, each of the solid rubber elastic layer 24*a* and the high thermal conductive elastic layer 24*b* has a uniform thickness and the external shape thereof is a straight shape.

Additionally, in the present embodiment, six types of high thermal conductive elastic layers 24*b* are prepared, and the rollers according to Examples 1 to 6 and the rollers according to Comparative Examples 1 to 6 formed using the high thermal conductive layers 24*b* are compared with each other, respectively.

Hereinafter, the high thermal conductive layers 24*b* of the rollers according to Comparative Examples 1 to 6 will be described.

Roller According to Comparative Example 1

Addition reaction type liquid silicone rubber undiluted solution (S component) is mixed with a filler (F component) as a spherical alumina having thermal conductivity of 36 W/(m·K) and an average particle diameter of 11 μm so that a ratio of F component is 40 vol % after the mixing process, thereby obtaining silicone rubber composite. Then, the high thermal conductive elastic layer 24*b* is formed on the solid rubber elastic layer 24*a* by the use of the silicone rubber composite.

Thermal conductivity λ in a longitudinal direction of the high thermal conductive elastic layer 24*b* according to Comparative Example 1 is 0.84 W/(m·K), and test piece hardness of the high thermal conductive elastic layer 24*b* is 40 in ASKER-C hardness.

Roller According to Comparative Example 2

Addition reaction type liquid silicone rubber undiluted solution (S component) is mixed with a filler (F component) as a spherical alumina having thermal conductivity of 200 W/(m·K) and an average particle diameter of 8.4 μm so that a ratio of F component is 35 vol % after the mixing process, thereby obtaining silicone rubber composite. Then, the high thermal conductive elastic layer 24*b* is formed on the solid rubber elastic layer 24*a* by the use of the silicone rubber composite.

Thermal conductivity λ in a longitudinal direction of the high thermal conductive elastic layer 24*b* according to Comparative Example 2 is 1.02 W/(m·K), and test piece hardness of the high thermal conductive elastic layer 24*b* is 51 in ASKER-C hardness.

Roller According to Comparative Example 3

Addition reaction type liquid silicone rubber undiluted solution (S component) is mixed with a filler (F component) as a spherical alumina having thermal conductivity of 36 W/(m·K) and an average particle diameter of 11 μm so that a ratio of F component is 50 vol % after the mixing process, thereby obtaining silicone rubber composite. Then, the high thermal conductive elastic layer 24*b* is formed on the solid rubber elastic layer 24*a* by the use of the silicone rubber composite.

Thermal conductivity λ in a longitudinal direction of the high thermal conductive elastic layer 24*b* of the roller according to Comparative Example 3 is 1.20 W/(m·K), and test piece hardness of the high thermal conductive elastic layer 24*b* is 58 in ASKER-C hardness.

Roller According to Comparative Example 4

Addition reaction type liquid silicone rubber undiluted solution (S component) is mixed with a filler (F component) as a spherical alumina having thermal conductivity of 200 W/(m·K) and an average particle diameter of 8.4 μm so that a ratio of F component is 40 vol % after the mixing process, thereby obtaining silicone rubber composite. Then, the high thermal conductive elastic layer 24*b* is formed on the solid rubber elastic layer 24*a* by the use of the silicone rubber composite.

Thermal conductivity λ in a longitudinal direction of the high thermal conductive elastic layer 24*b* of the roller according to Comparative Example 4 is 1.24 W/(m·K), and test piece hardness of the high thermal conductive elastic layer 24*b* is 63 in ASKER-C hardness.

Roller According to Comparative Example 5

Addition reaction type liquid silicone rubber undiluted solution (S component) is mixed with a filler (F component) as pitch based carbon fiber 100-05M having thermal conductivity of 900 W/(m·K) so that a ratio of F component is 35 vol % after the mixing process, thereby obtaining silicone rubber composite. The pitch based carbon fiber 100-05M will be described later. Then, the high thermal conductive elastic layer 24*b* is formed on the solid rubber elastic layer 24*a* by the use of the silicone rubber composite.

Thermal conductivity λ in a longitudinal direction of the high thermal conductive elastic layer 24*b* according to Comparative Example 5 is 39.22 W/(m·K), and test piece hardness of the high thermal conductive elastic layer 24*b* is 39 in ASKER-C hardness.

Roller According to Comparative Example 6

Addition reaction type liquid silicone rubber undiluted solution (S component) is mixed with a filler (F component) as pitch based carbon fiber 100-15M having a thermal conductivity of 900 W/(m·K) so that the ratio of the F component is 30 vol % after the mixing process, thereby obtaining a silicone rubber composite. The pitch based carbon fiber 100-15M will be described later. Then, the high thermal conductive elastic layer 24*b* is formed on the solid rubber elastic layer 24*a* by the use of the silicone rubber composite.

The thermal conductivity λ in a longitudinal direction of the high thermal conductive elastic layer 24*b* according to Comparative Example 6 is 65.78 W/(m·K), and the test piece hardness of the high thermal conductive elastic layer 24*b* is 35 in ASKER-C hardness.

The pitch based carbon fiber used in the rollers according to Comparative Examples 5 and 6 will be described.

100-05M: pitch based carbon fiber, trade name: XN-100-05M, manufacturer: Nippon Graphite Fiber Corporation, average fiber diameter: 9 μm, average fiber length L: 50 μm, and thermal conductivity: 900 W/(m·K)

100-15M: pitch based carbon fiber, trade name: XN-100-15M, manufacturer: Nippon Graphite Fiber Corporation, average fiber diameter: 9 μm, average fiber length L: 150 μm, and thermal conductivity: 900 W/(m·K)

3-3-2) Comparison Evaluation of Rollers According to Examples and Comparative Examples

Comparison Evaluation Example 1

Figure 13A:
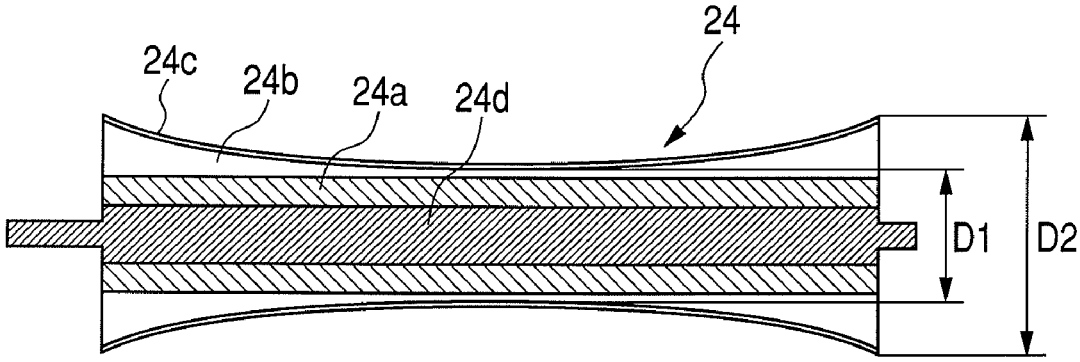
FIG. 13A is a diagram illustrating the rollers according to Examples 1, 2, 5, and 6.
Figure 13B:
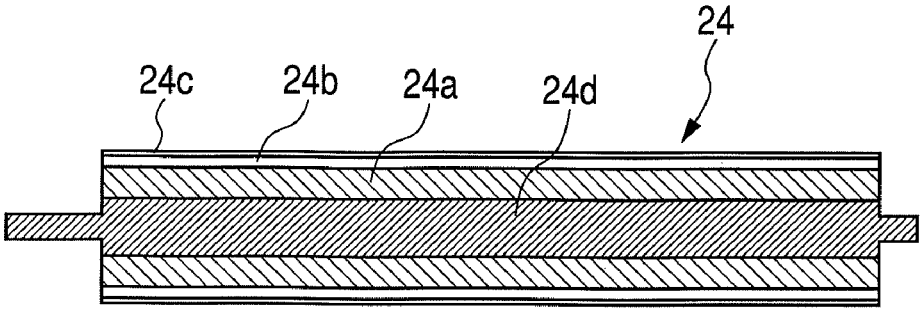
FIG. 13B is a diagram illustrating the rollers according to Comparative Examples 1, 2, 5, and 6.

FIGS. 13A and 13B are longitudinal sectional diagrams illustrating the roller according to Comparative Example and the roller according to Example which correspond to comparison objects in the comparison evaluation example. FIG. 13A illustrates the rollers according to Examples 1, 2, 5, and 6. FIG. 13B illustrates the roller according to Comparative Examples 1, 2, 5, and 6.

The properties of the solid rubber elastic layer 24*a* and the high thermal conductive elastic layer 24*b* of the roller according to Example 1 are the same as those according to Comparative Example 1. Accordingly, the thermal conductivity λ in a longitudinal direction of the high thermal conductive elastic layer 24*b* according to Example 1 is 0.84 W/(m·K), and the test piece hardness of the high thermal conductive elastic layer 24*b* is 40 in ASKER-C hardness (hereinafter, referred to as rubber thickness). In the roller according to Example 1 and the roller according to Comparative Example 1, as the high thermal conductive elastic layer 24*b*, the silicone rubber composite is used in which addition curing-type silicone rubber undiluted solution is mixed with a filler as alumina of 40 vol %. The external shape of the roller according to Comparative Example 1 is a straight shape, but the external shape of the roller according to Example 1 is an inversed crown shape of 200 μm. In FIG. 13, from the viewpoint of easy description, the external shape of the roller according to Example 1 is highlighted. Here, in the rollers according to Example 1 and Comparative Example 1, the solid rubber elastic layer 24*a* is formed in a straight shape by the use of a formation method, and the high thermal conductive elastic layer 24*b* is formed on the solid rubber elastic layer 24*a* by the use of a formation method.

Accordingly, in the rollers according to Example 1 and Comparative Example 1, the thickness of the solid rubber elastic layer 24*a* and the high thermal conductive elastic layer 24*b* is obtained as shown in Table 1.

TABLE 1

| | Roller according to Example 1 | Roller according to Comparative Example 1 |
|---|---|---|
| External Shape | Inversed crown Shape: 200 μm | Straight Shape: 3.0 mm |
| Elastic Layer 24a | Whole Area: 3.0 mm | Whole Area: 3.0 mm |
| High Thermal Conductive Elastic Layer 24b | Center: 1.0 mm, End Portion: 1.1 mm | Whole Area: 1.0 mm |
| Nip Width | Center: 7.8 mm, End Portion: 7.9 mm | Center: 7.7 mm, End Portion: 8.0 mm |

In the heat-fixing apparatus 6 illustrated in FIG. 2, when the rollers according to Example 1 and Comparative Example 1 are used as the pressure roller 24, and a pressure of 196 N acts on the rollers according to Example 1 and Comparative Example 1, the nip width at this time is obtained as shown in Table 1. In the roller according to Comparative Example 1, a difference between the end-portion nip width and the center nip width in a longitudinal direction of the roller according to Comparative Example 1 is 0.3 mm. On the contrary, in the roller according to Example 1, since the thickness of the high thermal conductive elastic layer 24*b* at the end-portion in a longitudinal direction is thicker than the thickness of the high thermal conductive elastic layer 24*b* at the center portion by 0.1 mm, the center nip width is substantially the same as the end-portion nip width in a longitudinal direction of the roller according to Example 1.

Comparison Evaluation Example 2

In the same manner as Comparison Evaluation Example 1, the rollers according to Example 2 and Comparative Example 2 are formed in a shape shown in FIG. 13. The property of the silicone rubber of the solid rubber elastic layer 24*a* and the high thermal conductive elastic layer 24*b* of the roller according to Example 2 is the same as that of Comparative Example 2. However, the filler of the high thermal conductive elastic layer 24*b* is changed with AlN having a higher thermal conductivity than that of the high thermal conductive elastic layer 24*b* of the roller according to Example 1. In case of AlN, the thermal conductivity is 1.02 W/(m·K) higher than 0.84 W/(m·K) of the roller according to Example 1 even when the mixing amount is 35 vol % less than that of alumina. Meanwhile, the rubber hardness of the high thermal conductive elastic layer 24*b* is hardened from 40 to 51. In the heat-fixing apparatus 6 illustrated in FIG. 2, when a pressure of 196 N acts on the rollers according to Example 2 and Comparative Example 2, the nip width at this time is obtained as shown in Table 2. The nip width of the roller according to Example 2 is narrower than that of the roller according to Example 1 as a whole, but a difference between the center nip width and the end-portion nip width in a longitudinal direction of the roller according to Example 2 is substantially the same as that of the roller according to Example 1.

TABLE 2

| | Roller according to Example 2 | Roller according to Comparative Example 2 |
|---|---|---|
| External Shape | Inversed crown Shape: 200 μm | Straight Shape |
| Elastic Layer 24a | Whole Area: 3.0 mm | Whole Area: 3.0 mm |
| High Thermal Conductive Elastic Layer 24b | Center: 1.0 mm, End Portion: 1.1 mm | Whole Area: 1.0 mm |
| Nip Width | Center: 7.6 mm, End Portion: 7.7 mm | Center: 7.5 mm, End Portion: 7.8 mm |

Comparison Evaluation Example 3

Figure 14A:
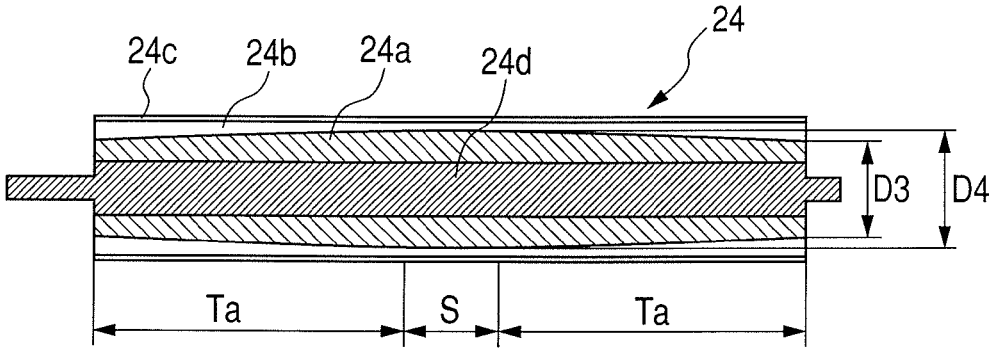
FIG. 14A is a diagram illustrating the rollers according to Examples 3 and 4 which correspond to comparison objects in Comparison Evaluation Examples 3 and 4.
Figure 14B:
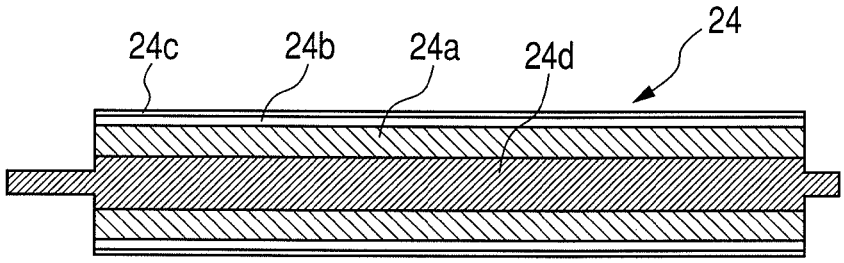
FIG. 14B is a diagram illustrating the rollers according to Comparative Examples 3 and 4 which correspond to comparison objects in Comparison Evaluation Examples 3 and 4.

FIGS. 14A and 14B are longitudinal sectional diagrams illustrating the roller according to Comparative Example and the roller according to Example which correspond to comparison objects in the comparison evaluation example. FIG. 14A illustrates the roller according to Example 3. FIG. 14B illustrates the roller according to Comparative Example 3.

The properties of the solid rubber elastic layer 24*a* and the high thermal conductive elastic layer 24*b* of the roller according to Example 3 are the same as those according to Comparative Example 3. In the rollers according to Example 3 and Comparative Example 3, in order to further improve the thermal conductivity of the high thermal conductive elastic layer 24*b* above that of the roller according to Example 1, the silicone rubber composite is used in which addition curing-type silicone rubber undiluted solution is mixed with a filler as alumina of 50 vol %. Additionally, in the present Comparison Evaluation Example, each of the external shapes of the rollers according to Example 3 and Comparative Example 3 is a straight shape. However, regarding the shape of the solid rubber elastic layer 24*a*, the roller according to Comparative Example 3 is formed in a straight shape, and the roller according to Example 3 is formed in a taper shape having a taper amount of 1 mm at Ta area. The taper amount indicates a difference between a center outer shape D4 and an end-portion outer shape D3 of the straight shape in a longitudinal direction of the roller according to Example 3 (D4-D3). The solid rubber elastic layer 24*a* is formed in a straight shape by the use of a formation method, and is formed in a taper shape by the use of a polishing process. Then, the high thermal conductive elastic layer 24*b* is formed on the solid rubber elastic layer 24*a*.

Accordingly, due to a sectional shape difference of the elastic layer including the solid rubber elastic layer 24*a* and the high thermal conductive elastic layer 24*b*, the thickness of the solid rubber elastic layer 24*a* and the high thermal conductive elastic layer 24*b* of the rollers according to Example 3 and Comparative Example 3 is obtained as shown in Table 3.

TABLE 3

| | Roller according to Example 3 | Roller according to Comparative Example 3 |
|---|---|---|
| External Shape | Straight Shape | Straight Shape |
| Elastic Layer 24a | Center: 3.0 mm, End portion: 2.0 mm | Whole Area: 3.0 mm |
| High Thermal Conductive Elastic Layer 24b | Center: 1.0 mm, End Portion: 2.0 mm | Whole Area: 1.0 mm |
| Nip Width | Center: 7.4 mm, End Portion: 7.5 mm | Center: 7.2 mm, End Portion: 7.7 mm |

In the heat-fixing apparatus 6 illustrated in FIG. 2, when a pressure of 196 N acts on the rollers according to Example 3 and Comparative Example 3, the nip width is obtained as shown in Table 3. In the roller according to Comparative Example 3, the difference between the end-portion nip width and the center nip width in a longitudinal direction of the roller according to Comparative Example 3 is 0.5 mm. On the contrary, in the roller according to Example 3, the nip width is narrow as a whole, but the center nip width is substantially the same as the end-portion nip width in a longitudinal direction of the roller according to Example 3.

Comparison Evaluation Example 4

In the same manner as Comparison Evaluation Example 3, the rollers according to Example 4 and Comparative Example 4 are formed. FIGS. 14A and 14B are longitudinal sectional diagrams illustrating the roller according to Comparative Example and the roller according to the Example which corresponds to comparison objects in the comparison evaluation example. FIG. 14A illustrates the roller according to Example 4. FIG. 14B illustrates the roller according to Comparative Example 4. The properties of the solid rubber elastic layer 24*a* and the high thermal conductive elastic layer 24*b* of the roller according to Example 4 are the same as those according to Comparative Example 4. However, the filler of the high thermal conductive elastic layer 24*b* is changed with AlN having a higher thermal conductivity than that of the high thermal conductive elastic layer 24*b* of the roller according to Example 3. In case of AlN, the thermal conductivity is 1.24 W/(m·K) higher than 1.196 W/(m·K) of the roller according to Example 3, even when the mixing amount is 40 vol % less than that of alumina of the roller according to Example 3. Meanwhile, the rubber hardness of the high thermal conductive elastic layer 24*b* is hardened from 58 to 63. In the heat-fixing apparatus 6 illustrated in FIG. 2, when a pressure of 196 N acts on the rollers according to Example 4 and Comparative Example 4, the nip width at this time is obtained as shown in Table 4. The nip width of the roller according to Example 4 is narrower than that of the roller according to Example 3 as a whole, but the difference between the center nip width and the end-portion nip width in a longitudinal direction of the roller according to Example 4 is substantially the same as that of the roller according to Example 3.

TABLE 4

| | Roller according to Example 4 | Roller according to Comparative Example 4 |
|---|---|---|
| External Shape | Straight Shape | Straight Shape |
| Elastic Layer 24a | Center: 3.0 mm, End portion: 2.0 mm | Whole Area: 3.0 mm |
| High Thermal Conductive Elastic Layer 24b | Center: 1.0 mm, End Portion: 2.0 mm | Whole Area: 3.0 mm |
| Nip Width | Center: 7.2 mm, End Portion: 7.3 mm | Center: 7.0 mm, End Portion: 7.5 mm |

Additionally, the elastic layer may be formed in combination of the inversed crown shape of the high thermal conductive elastic layer 24*b* of the roller according to Example 1 shown in FIG. 13 and the taper shape of the solid rubber elastic layer 24*a* of the roller according to Example 4 shown in FIG. 14. By adopting the configuration of the elastic layer, it is possible to reduce the difference between the center nip width and the end-portion nip width in a longitudinal direction in accordance with the difference in rubber hardness or the thickness of the high thermal conductive elastic layer 24*b*.

Comparison Evaluation Example 5

In the same manner as Comparison Evaluation Example 1, the rollers according to Example 5 and Comparative Example 5 are formed in a shape shown in FIG. 13. The property of the silicone rubber of the solid rubber elastic layer 24*a* and the high thermal conductive elastic layer 24*b* of the roller according to Example 5 is the same as that of Comparative Example 5. In the rollers according to Example 5 and Comparative Example 5, in order to further improve the thermal conductivity of the high thermal conductive elastic layer 24*b*, the silicone rubber composite is used in which addition curing-type silicone rubber undiluted solution is mixed with a filler as carbon fiber of 35 vol %. The external shape and formation method of the rollers according to Example 5 and Comparative Example 5 are the same as those of the rollers according to Example 1 and Comparative Example 1 shown in FIG. 13.

Accordingly, due to a sectional shape difference of the elastic layer including the solid rubber elastic layer 24*a* and the high thermal conductive elastic layer 24*b*, the thickness of the solid rubber elastic layer 24*a* and the high thermal conductive elastic layer 24*b* of the rollers according to Example 5 and Comparative Example 5 is obtained as shown in Table 5.

TABLE 5

| | Roller according to Example 5 | Roller according to Comparative Example 5 |
|---|---|---|
| External Shape | Inversed crown Shape: 200 μm | Straight Shape |
| Elastic Layer 24a | Whole Area: 3.0 mm | Whole Area: 3.0 mm |
| High Thermal Conductive Elastic Layer 24b | Center: 1.0 mm, End Portion: 1.1 mm | Whole Area: 1.0 mm |
| Nip Width | Center: 8.0 mm, End Portion: 8.1 mm | Center: 7.9 mm, End Portion: 8.2 mm |

In the heat-fixing apparatus 6 illustrated in FIG. 2, when a pressure of 196 N acts on the rollers according to Example 5 and Comparative Example 5, the nip width is obtained as shown in Table 5. In the roller according to Comparative Example 5, the difference between the end-portion nip width and the center nip width in a longitudinal direction of the roller according to Comparative Example 5 is 0.3 mm. On the contrary, in the roller according to Example 5, the nip width is narrower than those of the rollers according to Examples 1 and 2 as a whole, but the center nip width is substantially the same as the end-portion nip width in a longitudinal direction of the roller according to Example 5.

This is because the rubber hardness of the high thermal conductive elastic layer 24*b* of the roller according to Example 5 is reduced from 40 to 35, the high thermal conductive elastic layer 24*b* of the roller according to Example 1 having a rubber hardness of 40. Accordingly, it is possible to further broaden the nip width as compared to those of the rollers according to Examples 1 and 2. Meanwhile, it is possible to largely increase the thermal conductivity in a longitudinal direction of the high thermal conductive elastic layer 24*b* of the roller according to Example 5 from 0.84 W/(m·K) to 39.22 W/(m·K), the thermal conductivity of the roller according to Example 1 being 0.84 W/(m·K).

Comparison Evaluation Example 6

In the same manner as Comparison Evaluation Example 5, the rollers according to Example 6 and Comparative Example 6 are formed. The properties of the solid rubber elastic layer 24*a* and the high thermal conductive elastic layer 24*b* of the roller according to Example 6 are the same as those according to Comparative Example 5. However, in the roller according to Example 6, the fiber length L and the input amount of the carbon fiber as a filler of the high thermal conductive elastic layer 24*b* are different from those of the carbon fiber of the roller according to Example 5. Specifically, the fiber length L increases from 50 μm to 150 μm, but a mixed amount of the carbon fiber decreases from 35 vol % to 30 vol %. However, the thermal conductivity in a longitudinal direction of the high thermal conductive elastic layer 24*b* increases from 39.22 W/(m·K) to 65.78 W/(m·K), the thermal conductivity of the roller according to Example 5 being 39.22 W/(m·K), but the rubber hardness is softened from 39 to 35. In the heat-fixing apparatus 6 illustrated in FIG. 2, when a pressure of 196 N acts on the rollers according to Example 6 and Comparative Example 6, the nip width at this time is obtained as shown in Table 6. The nip width of the roller according to Example 6 is wider than that of the roller according to Example 5 as a whole, but the center nip width is the same as that of the end-portion nip width in a longitudinal direction of the roller according to Example 6.

TABLE 6

| | Roller according to Example 6 | Roller according to Comparative Example 6 |
|---|---|---|
| External Shape | Inversed crown Shape: 200 μm | Straight Shape |
| Elastic Layer 24a | Whole Area: 3.0 mm | Whole Area: 3.0 mm |
| High Thermal Conductive Elastic Layer 24b | Center: 1.0 mm, End Portion: 1.1 mm | Whole Area: 3.0 mm |
| Nip Width | Center: 8.2 mm, End Portion: 8.2 mm | Center: 8.0 mm, End Portion: 8.3 mm |

Comparison Evaluation Example 7

As a Comparative Example against Examples 1 to 6, a case will be described in which the whole elastic layer of the pressure roller includes the solid rubber elastic layer 24*a*.

Figure 15A:
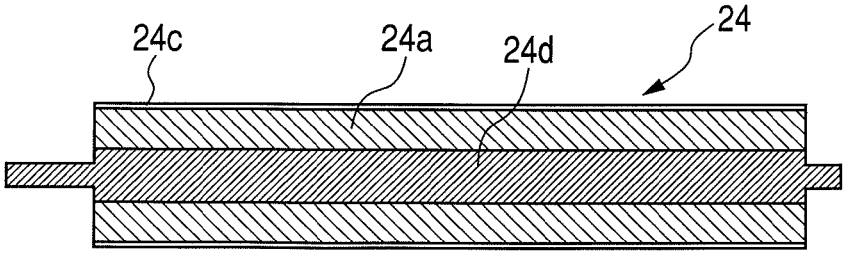
FIG. 15A is a diagram illustrating the roller according to Comparative Example 7-1 which corresponds to a comparison object in Comparison Evaluation Example 7.
Figure 15B:
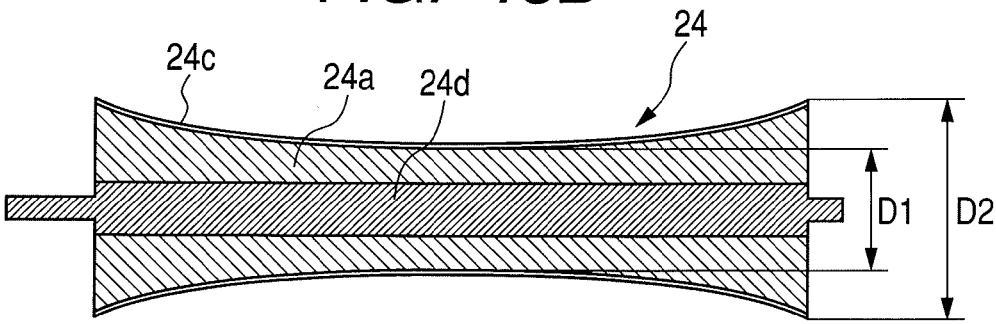
FIG. 15B is a diagram illustrating the roller according to Comparative Example 7-2 which corresponds to a comparison object in Comparison Evaluation Example 7.

FIG. 15 is a diagram illustrating the roller according to Comparative Example 7 which corresponds to a comparison object in Comparison Evaluation Example 7. FIG. 15A is a longitudinal sectional diagram illustrating the roller according to Comparative Example 7-1 of which an external shape is a straight shape. FIG. 15B is a longitudinal sectional diagram illustrating the roller according to Comparative Example 7-2 of which an external shape is an inversed crown shape.

In the two types of rollers according to Comparative Examples, that is, the roller according to Comparative Example 7-1 shown in FIG. 15A and the roller according to Comparative Example 7-2 shown in FIG. 15B, the solid rubber elastic layer 24*a* having a thickness of 4 mm (single layer) is formed on the metal core 24*d* addition reaction curing-type silicon rubber having density of 1.20 g/cm$^3$ and a formation method. Thermal conductivity λ in a longitudinal direction of the solid rubber elastic layer 24*a* according to Comparative Example 7 is 0.2 W/(m·K), and the test piece hardness of the solid rubber elastic layer 24*a* is 32 in ASKER-C hardness.

Additionally, in the heat-fixing apparatus 6 illustrated in FIG. 2, when a pressure of 196 N acts on the two types of rollers according to Comparative Example 7, the nip width formed at this time is obtained as shown in Table 7. In the roller according to Comparative Example 7 of which the external shape is a straight shape, the difference between the end-portion nip width and the center nip width in a longitudinal direction of the roller according to Comparative Example 7 is 0.3 mm. On the contrary, in the roller according to Comparative Example 7 of which the external shape is an inversed crown shape of 200 μm, the difference between the end-portion nip width and the center nip width in a longitudinal direction of the roller according to Comparative Example 7 is 0.5 mm.

TABLE 7

| | Roller according to Example 7 | Roller according to Comparative Example 7 |
|---|---|---|
| External Shape | Inversed crown Shape: 200 μm | Straight Shape |
| Elastic Layer 24a | Center: 4.0 mm, End portion: 4.1 mm | Whole Area: 4.0 mm |

TABLE 7-continued

| | Roller according to Example 7 | Roller according to Comparative Example 7 |
|---|---|---|
| High Thermal Conductive Elastic Layer 24b | None | None |
| Nip Width | Center: 7.8 mm, End Portion: 8.3 mm | Center: 7.8 mm, End Portion: 8.1 mm |

When the pressure roller, in which the whole elastic layer includes the single solid rubber elastic layer 24*a* and which is formed in a straight shape, is formed in an inversed crown shape, like the roller according to Comparison Evaluation Example 7, the end-portion nip width in a longitudinal direction of the pressure roller having an inversed crown shape tends to increase.

Meanwhile, as shown in Comparison Evaluation Examples 1, 2, 5, and 6, the thickness at the end-portion is thicker than the thickness at the center portion in a longitudinal direction of the upper elastic layer (high thermal conductive elastic layer 24*b*) of the two-layer elastic layer of the pressure roller. Accordingly, it is possible to reduce the difference between the end-portion nip width and the center nip width in a longitudinal direction of the pressure roller. Additionally, since the thickness of the upper elastic layer gradually increases from the center to the end portion of the pressure roller, the nip-width shape in a longitudinal direction of the pressure roller is smooth, thereby more reliably conveying the recording material.

Additionally, as shown in Comparison Evaluation Examples 3 and 4, even when the thickness at the center portion is thicker than the thickness of the end-portion in a longitudinal direction of the lower elastic layer (solid rubber elastic layer 24*a*) of the two-layer elastic layer of the pressure roller, it is possible to reduce the difference between the end-portion nip width and the center nip width. Even when the thickness of the lower elastic layer gradually increases from the end portion to the center of the pressure roller, the nip-width shape in a longitudinal direction of the pressure roller is smooth, thereby more reliably conveying the recording material.

In the present embodiment, solid rubber is used as material of the lower elastic layer of the two-layer elastic layer, but the material of the lower elastic layer is not limited to the solid rubber. In a fixing apparatus mounted to a low-speed printer not requiring high durability, foamed silicone rubber disclosed in Japanese Patent Publication No. H04-077315 may be used as material of the lower elastic layer of the pressure roller. Accordingly, it is possible to decrease the thermal conductivity of the lower elastic layer down to 0.12 W/(m·K) or so. For this reason, it is possible to provide the high-efficient fixing apparatus capable of restricting temperature irregularity in a longitudinal direction of the pressure roller while preventing heat emission to the metal core 24*d* by the use of the high thermal conductive elastic layer 24*b*. Additionally, a heat insulation of the lower elastic layer may be realized by using resin microballoon disclosed in Japanese Patent Application Laid-Open No. H08-012888 and in Japanese Patent Application Laid-Open No. H05-209080 as a filler of the silicon rubber.

The pressure roller 24 according to Embodiments 1 and 2 includes the two-layer elastic layer in which the upper layer is the high thermal conductive elastic layer 24*b* having higher thermal conductivity and the lower layer is the elastic layer 24*a* having lower thermal conductivity than that of the high thermal conductive layer 24*b*. The hardness of the high thermal conductive elastic layer 24*b* is larger than that of the elastic layer 24*a*. Then, the two-layer elastic layer is formed in combination of the elastic layer 24*a* and the high thermal conductive elastic layer 24*b* so that the thickness at the end-portion is thicker than the thickness at the center portion in a longitudinal direction of the high thermal conductive elastic layer 24*b*. Accordingly, since the pressure roller 24 according to Embodiments 1 and 2 is capable of reducing the difference between the center nip width and the end-portion nip width in a longitudinal direction of the pressure roller 24, it is possible to uniformly fix the toner onto the recording material and to reliably convey the recording material in a longitudinal direction of the pressure roller 24.

(4) Others 4-1) In the film heating-type heat-fixing apparatus 6 according to the above-described embodiments, the heater 22 is not limited to the ceramic heater. For example, the heater 22 may be a contact heater using nichrome wire or an electromagnetic induction heating member such as an iron plate piece. The heater 22 is not necessarily located at the nip part.

An electromagnetic induction heating-type heating device may be configured by forming the film 23 as an electromagnetic induction heating metal film.

An apparatus may be configured in which the film 23 is suspended on a plurality of suspension members in a tension state and is rotationally driven by a driving roller. Alternatively, an apparatus may be configured in which the film 23 as a longitudinal member having an end is wound on a supply shaft.

4-2) The heat-fixing apparatus is not limited to the film heating type, but may be a thermo roller type.

4-3) The heat-fixing apparatus is not limited to the heat-fixing apparatus according to the above-described embodiments, but may be an image heating apparatus for temporarily fixing unfixed image or an image heating apparatus for improving the quality of a surface property, such as gloss, by reheating a recording material bearing an image thereon.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-284915, filed Nov. 1, 2007, which is hereby incorporated by reference herein in its entirety.

What is claimed is:

1. An image heating apparatus comprising:

a heating member; and a pressure roller that contacts said heating member, said pressure roller including a metal core, a first elastic layer, and a second elastic layer provided on the outside of the first elastic layer, the second elastic layer having a thermal conductivity higher than the thermal conductivity of the first elastic layer, wherein the heating member and the pressure roller are configured to pinch and convey a recording material bearing a toner image thereon so that the recording material is heated, and wherein each of the end portions of the second elastic layer is thicker than a center portion of the second elastic layer in an axial direction of said pressure roller, and wherein the thickness of the first elastic layer gradually decreases from the center portion of the first elastic layer to the end portions of the first elastic layer in an axial direction of the pressure roller.

2. An image heating apparatus according to claim 1, wherein at least one component of alumina, aluminum nitride, and carbon fiber is dispersed in the second elastic layer.

3. An image heating apparatus according to claim 1, wherein said heating member includes a cylindrical film and a heater contacting an inner surface of the film, and wherein said pressure roller and the heater form a nip part to pinch and convey the recording material through the cylindrical film.

4. A pressure roller used in an image heating apparatus comprising:

a metal core;

a first elastic layer; and a second elastic layer provided on the outside of the first elastic layer, the second elastic layer having a thermal conductivity higher than the thermal conductivity of the first elastic layer, wherein each of the end portions of the second elastic layer is thicker than a center portion of the second elastic layer in an axial direction of said pressure roller, wherein the thickness of the first elastic layer gradually decreases from the center portion of the first elastic layer to the end portions of the first elastic layer in an axial direction of the pressure roller.

5. A pressure roller according to claim 4, wherein at least one component of alumina, aluminum nitride, and carbon fiber is dispersed in the second elastic layer.

* * * * *